US006064837A

United States Patent [19]

Hashimoto et al.

[11] Patent Number: 6,064,837

[45] Date of Patent: May 16, 2000

[54] IMAGE FORMING APPARATUS HAVING A DEVELOPING/CLEANING DEVICE

[75] Inventors: Kouichi Hashimoto, Numazu; Atsushi Takeda, Mishima; Fumiteru Gomi, Shizuoka-ken; Yoshiyuki Komiya, Mishima, all of Japan

[73] Assignee: Canon Kabushiki Kaisha, Tokyo, Japan

[21] Appl. No.: 09/185,602

[22] Filed: Nov. 3, 1998

[30] Foreign Application Priority Data

Nov. 4, 1997 [JP] Japan ..... 9-302241

[51] Int. Cl.[7] ..... G03G 15/00

[52] U.S. Cl. ..... 399/50; 399/53; 399/149; 399/175

[58] Field of Search ..... 399/150, 149, 399/127, 128, 129, 175, 50, 53, 66, 169, 234, 235, 174, 100

[56] References Cited

U.S. PATENT DOCUMENTS

| | | | |
|---|---|---|---|
| 5,282,007 | 1/1994 | Oshiumi | 399/150 |
| 5,541,717 | 7/1996 | Saito et al. | 399/150 |
| 5,659,852 | 8/1997 | Chigono et al. | 399/175 |
| 5,822,659 | 10/1998 | Ishiyama | 399/175 |
| 5,845,172 | 12/1998 | Saito et al. | 399/50 |
| 5,864,736 | 1/1999 | Shimada et al. | 399/149 |

FOREIGN PATENT DOCUMENTS

| | | |
|---|---|---|
| 766 146 A2 | 4/1997 | European Pat. Off. . |
| 5-66150 | 3/1993 | Japan . |
| 9-096997 | 4/1997 | Japan . |

*Primary Examiner*—Sophia S. Chen
*Attorney, Agent, or Firm*—Fitzpatrick, Cella, Harper & Scinto

[57] ABSTRACT

An image forming apparatus includes an image bearing member for bearing an image. A charging device is supplied with a voltage. The charging device includes a magnetic brush contactable to the image bearing member to electrically charge the image bearing member. A developing device develops, at a developing position, an electrostatic image formed on the image bearing member using a charging operation of the charging device, with toner having the same polarity as a charging polarity of the charging device, into a toner image. The developing device is capable of removing residual toner from the image bearing member. The developing device stops its developing operation if an area of the image bearing member, which has been charged by the charging device when the charging device is being supplied with an oscillating voltage in the form of superimposed AC and DC voltages, is still at the developing position.

8 Claims, 9 Drawing Sheets

IMAGE FORMING APPARATUS HAVING A DEVELOPING/CLEANING DEVICE

FIELD OF THE INVENTION AND RELATED ART

The present invention relates to an image forming apparatus such as a copying machine, a printer, or a facsimile machine. In particular, it relates to such ar image forming apparatus that is equipped with a charging device which employs a magnetic brush placeable in contact with the image bearing member of the image forming apparatus.

Generally speaking, in conventional image forming apparatuses, a corona based charging device has been used as a means for charging an image bearing member such as an electrophotographic photosensitive member, an electrostatically recordable dielectric member, and the like.

Further, in recent years, contact type charging apparatuses have been put to practical use because of their benefits such as low ozone production, low power consumption, and the like. These contact type charging apparatuses employ such a system that charges an image bearing member, i.e., a member to be charged, by placing a charging member, which is supplied with voltage, in contact with the image bearing member. Among these apparatuses, those which employ a roller based charging system which uses an electrically conductive roller have been particularly favored because of their reliability.

However, in the case of a roller based charging system, an image bearing member is charged by electrical discharge from a charging member to the image bearing member. Therefore, it suffers from a problem that the electrical charge which the image bearing member receives varies in potential level depending upon changes in ambience. This is because the changes in ambience affect the electrical resistance of the charge roller and the image bearing member.

Thus, efforts have been made to solve this problem. For example, Japanese Patent Application No. 66150/1993, or the like, discloses a charging system relatively immune to ambient changes, according to which an image bearing member is charged by applying voltage to an electrically conductive, contact type charging member to inject electrical charge into traps present in the peripheral surface of an image bearing member. This charge injecting system is relatively independent from ambient changes, and also does not depend on electrical discharge. Therefore, it enjoys the advantages that the potential level of the voltage to be applied to charge the image bearing member has only to be approximately as high as the potential level to which the image bearing member is to be charged, and also, it does not generate ozone which reduces the life of the image bearing member.

As for the conductive, contact type charging member, a fur brush, a magnetic brush, and the like may be listed. However, a fur brush suffers from a phenomenon that its charging performance deteriorates due to the collapsing of the individual bristles of the fur brush, which is likely to occur when the cumulative usage of the fur brush increases or the fur brush is kept unused for a long time, whereas a magnetic brush does not suffer from such a phenomenon, rendering it more reliable in charging performance than the fur brush.

Referring to FIG. 11, in an image forming apparatus in which the electrophotographic photosensitive member 100 in the form of a drum is charged by placing the electrically conductive magnetic particles 102 (hereinafter, "magnetic particles") borne on the sleeve 101 of the magnetic brush based charging apparatus, in contact with the photosensitive member 100, the electrical circuit formed among the sleeve 101, the magnetic particles 102, and the photosensitive member 100 is equivalent to a serial electrical circuit composed of a resistor R and a condenser C illustrated in FIG. 11. In an ideal charge injection process based on the magnetic particles 102, the electrical potential of a given point of the peripheral surface of the photosensitive member increases to a level substantially equal to the potential level of the applied voltage as the condenser C is charged, while the given point of the peripheral surface of the photosensitive member 100 is in contact with the magnetic particles 102 (width of charging nip x peripheral velocity of photosensitive drum).

In recent years, for the sake of size reduction and simplification, and also for the sake of prevention of waste toner production, that is, an environmental concern, cleanerless systems have been put to practical use, which recover by a developing device the toner particles which remain on the peripheral surface of the photosensitive drum 1 after image transfer. However, if a magnetic brush based charging device is used as the charging device in a cleanerless image forming apparatus, toner particles mix into the magnetic brush composed of magnetic particles, gradually increasing the electrical resistance of the magnetic brush. More specifically, in a cleanerless image forming apparatus, the toner particles which remain on the peripheral surface of the photosensitive drum 1 are temporarily recovered by the magnetic based charging device to erase the image pattern left on the photosensitive drum 1 by the preceding image formation cycle. As a result, the resistance of the charging device becomes larger.

Consequently, a sufficient amount of electrical charge is not transferred from the magnetic brush to the photosensitive drum 1, in the charging nip, and therefore, the electrical potential level of the peripheral surface of the photosensitive drum 1 after passing the charging nip is smaller than the potential level of the applied voltage (hereinafter, difference in potential level between the peripheral surface of photosensitive drum 1 ad applied voltage will be referred to as "$\Delta V$).

As the surface potential level of the photosensitive drum 1 decreases without the presence of a means for detecting the surface potential level of the photosensitive drum 1 and a means for controlling the development bias, toner particles adhere to the photosensitive drum 1, on the portions correspondent to the background portions of a latent image; in other words, fog occurs. Also, if the aforementioned potential level difference $\Delta V$ is large, the magnetic particles adhere to the peripheral surface of the photosensitive drum 1, causing the photosensitive drum 1 to be insufficiently charged.

On the other hand, as the toner particles which have mixed into the magnetic brush are given a triboelectrical charge with the same polarity as that of the surface potential of the photosensitive drum 1 by coming in contact with the magnetic particles, they are expelled out of the magnetic brush, onto the peripheral surface of the photosensitive drum 1, by the aforementioned potential level difference $\Delta V$, and then are recovered by developing apparatus. More specifically, referring to FIG. 12, the image forming apparatus is configured so that the potential level Vdc of the DC bias applied to the developing device becomes low enough, relative to the surface potential level of the photosensitive drum 1 (potential level of DC bias applied in charging photosensitive drum 1), to cause the charging device (magnetic brush based charging apparatus) to expel the toner particles. The toner particles which have been expelled out of the magnetic brush onto the peripheral surface of the photosensitive drum 1 are recovered into the developing device by the potential level difference between the portions of the peripheral surface of the photosensitive drum 1 correspondent to the dark portions of the latent image, and the DC voltage applied to the developing device, and the mechanical contact.

The magnitude of the aforementioned potential level difference ΔV has been known to be dependent upon the bias applied to the photosensitive drum 1, and becomes greater when the charge bias is composed of AC voltage and DC voltage than when the charge bias is composed of only DC voltage. This is thought to be caused by the following: it is easier for the magnetic particles in the magnetic brush to move when AC voltage is applied, than when not. In other words, application of AC voltage increases the frequency of the contact between the magnetic particles and the photosensitive drum 1, and also, a magnetic particle has a property that the stronger the electric field in which the magnetic particle is, the lower the electric resistance of the magnetic particle becomes. Therefore, when AC voltage is applied, the magnetic particles are more easily charged. This property of magnetic particles is used by the method disclosed in E.P. No. 766,146. According to this method, the toner density within a charging device is kept low by using two different biases: during the periods in which an image is to be formed, compound bias composed of AC voltage and DC voltage is applied, and during the periods in which toner particles are to be expelled (periods in which no image is to be formed, for example, sheet intervals or post-image formation rotation periods), bias composed of only DC voltage is applied. In this case, it is possible to cause the toner particles to be expelled by simply reducing the amplitude of the compound bias composed of AC voltage and DC voltage during the toner expelling periods, instead of completely turning off the compound voltage. Further, in this case, the timings set to end the charging process and the developing process play an important role, in particular, if the apparatus is configured to expel the toner particles during the post-image formation rotation periods.

More specifically, if the development bias is turned off and/or the rotation of the development sleeve is stopped, before the portion of the peripheral surface of the photosensitive drum 1 correspondent to the point in time at which the status of the charge bias applied to charge the photosensitive drum 1 is OFF passes the development station, not all the toner particles, which have been expelled out of the charging device, are recovered by the developing device, and therefore, the charging device for image transfer (corona based charging device, roller based charging device, or the like), and/or the transfer belt are contaminated with the toner particles which have failed to be recovered. As a result, images are improperly transferred and/or the recording medium is soiled on the back side.

On the contrary, if the development bias is turned off and/or the rotation of the development sleeve is stopped, later than the point in time at which the line on the peripheral surface of the photosensitive drum 1 correspondent to the point in time at which the charge bias applied to charge the photosensitive drum 1 is turned off passes the development station, an electric field which causes the toner particles to transfer from the developing device onto the photosensitive drum is generated in the development station, and therefore, a large amount of toner particles are adhered to the peripheral surface of the photosensitive drum 1, on the region between the line correspondent to the point in time at which the charge bias is turned off and the like correspondent to the point in time at which the development bias is turned off. As a result, images are improperly transferred, and the recording medium is soiled on the back side. In addition, this large amount of toner particles having adhered to the peripheral surface of the photosensitive drum 1 mixes into the charging device, causing a drastic decline in charging performance.

Thus, the image forming apparatus must be configured so that the line on the peripheral surface of the photosensitive drum 1 correspondent to the point in time at which the charge bias is turned off precisely coincides with the line on the peripheral surface of photosensitive drum 1 correspondent to the point in time at which the development bias is turned off. However, in reality, it is rather difficult to make the two lines always coincide, because there are fluctuations in the time it takes for a bias power source to start up, the time if takes for a motor to start up, the clutch response time, the peripheral velocity of the photosensitive drum 1, and the like.

It is possible to end each image formation cycle after preventing the occurrence of the fog, and the adhesion of the magnetic particles, in the development station, by gradually reducing the potential level of the DC component of the charge bias, and the potential level of the development bias. However, because this method takes so much time to end each image formation cycle, it suffers from a problem that it makes an image forming apparatus slow to stop when a paper jam occurs.

SUMMARY OF THE INVENTION

The primary object of the present invention is to provide an image forming apparatus in which the amount of the toner particles which remain on the peripheral surface of the image bearing member after the end of the development process is extremely small.

Another object of the present invention is to provide an image forming apparatus in which the amount by which the toner particles transferred from the magnetic brush based charging apparatus onto the image bearing member remain on the image bearing member is extremely small.

Another object of the present invention is to provide an image forming apparatus in which the region of the image bearing member, which will be in the development station at the end of the development process, is charged in advance by the charging means.

Another object of the present invention is to provide an image forming apparatus in which the amount of the toner particles which remain on the image bearing member, on the region which is in the development station at the end of the development process, is small.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinafter, the embodiments of the present invention will be described with reference to the drawings.

Embodiment 1

Figure 1:
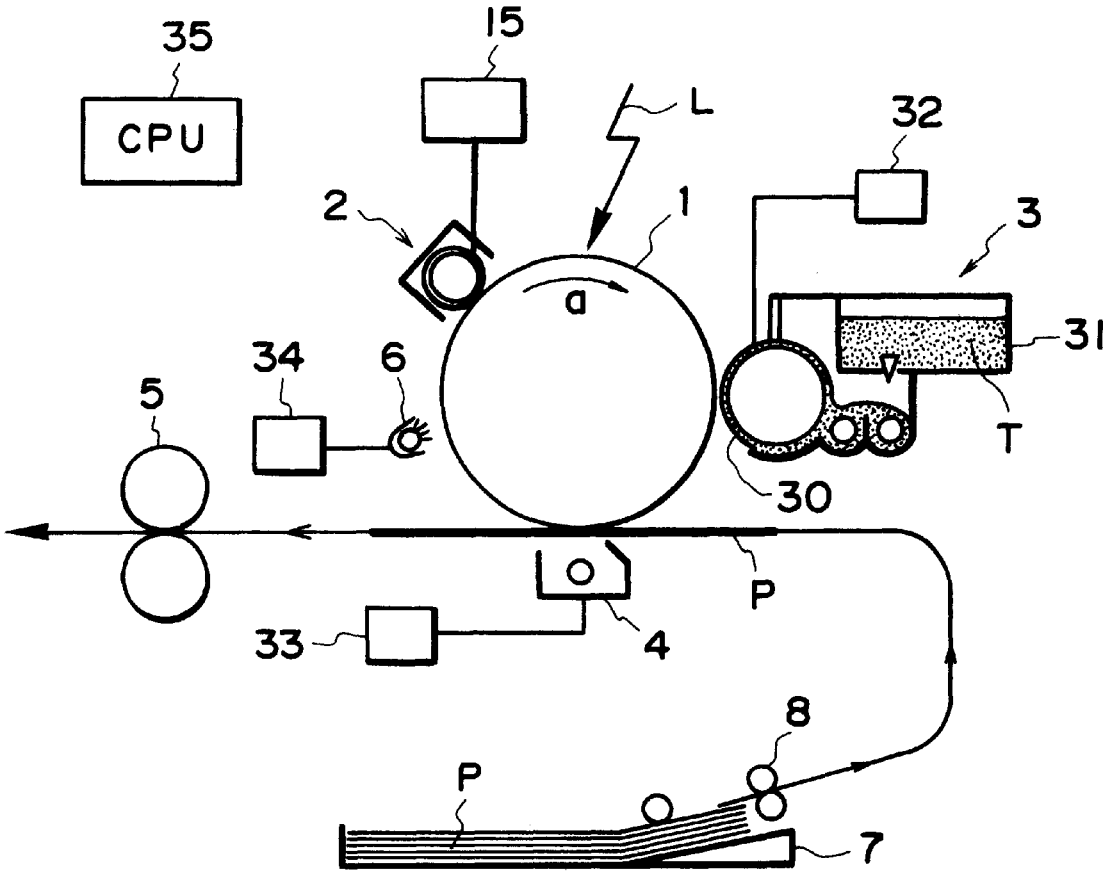
FIG. 1 is a schematic section of the image forming apparatus in the first embodiment of the present invention, and depicts the general structure thereof.

FIG. 1 is a schematic section of the image forming apparatus in this embodiment, and depicts the general structure thereof. The image forming apparatus in this embodiment employs a magnetic brush based charging apparatus as a means for charging the image bearing member, and also it is a cleanerless apparatus, that is, an image forming apparatus which is not equipped with a dedicated cleaner, which usually is disposed in a conventional image forming apparatus, adjacent to the photosensitive drum, on the downstream side of the image transfer station and/or on the upstream side of the charging station.

This image forming apparatus is equipped with an electrophotographic photosensitive member 1 (hereinafter, "photosensitive drum") in the form of a drum, which rotates in the direction indicated with an arrow mark a. It also is equipped with a magnetic brush based charging apparatus 2, an exposing apparatus (unillustrated) as a means for forming an electrostatic latent image, a developing apparatus 3, a transferring apparatus 4, a fixing apparatus 5, and a pre-exposing lamp 6 as an exposing means, which are disposed around the photosensitive drum 1.

Figure 13:
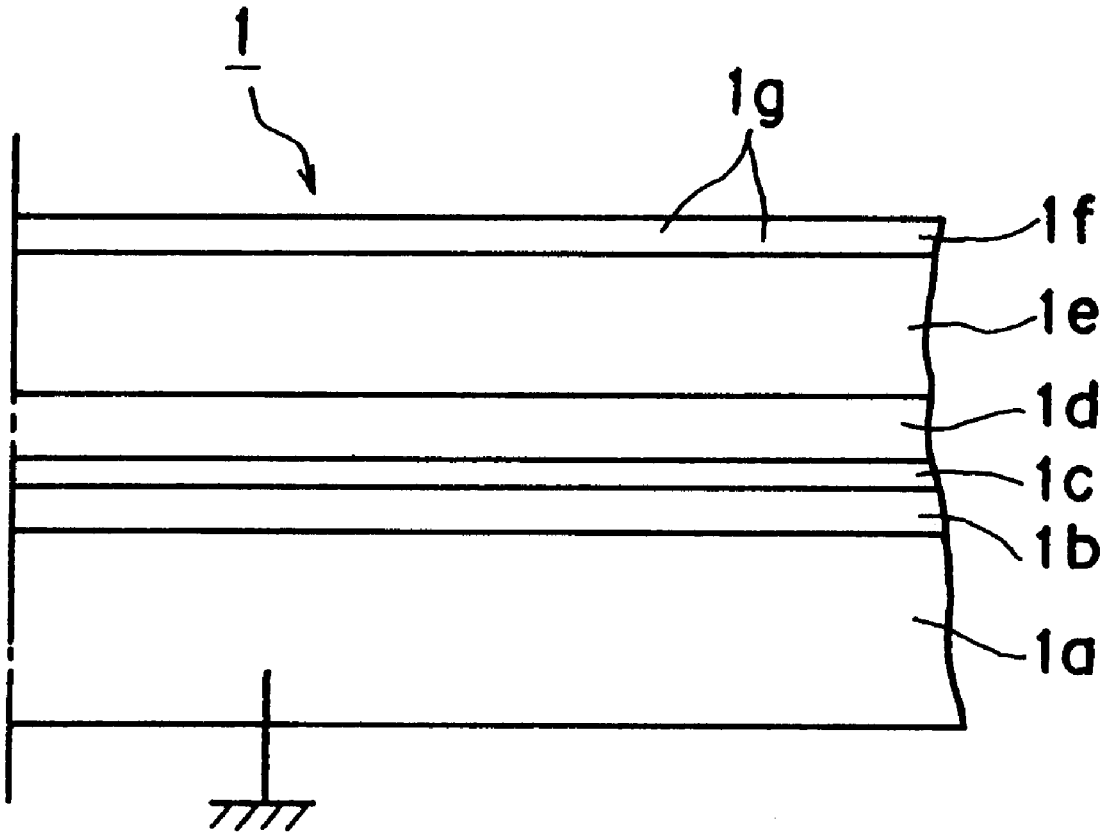
FIG. 13 is an enlarged cross section of the surface portion of the photosensitive drum in accordance with the present invention.

The photosensitive drum 1 in this embodiment is constituted of a negatively chargeable organic photoconductor. As depicted in FIG. 13, it consists of a base member 1*a*, which is a piece of aluminum drum with an external diameter of 30 mm, and five functional layers. It is rotatively driven in the direction indicated by the arrow mark a at a process speed (peripheral velocity) of 150 mm/sec.

The first layer 1*b* is an approximately 20 μm thick electrically conductive undercoat layer, which is coated on the base drum 1*a* to rectify the defects of the base drum 1*a* and also to prevent the occurrence of the moire effect which is caused by the reflection of the laser beam L projected from the exposing apparatus (unillustrated). The second layer 1*c* is a positive charge injection prevention layer, which plays a role in preventing the positive charge from being injected from the aluminum base member, and canceling the negative charge given to the peripheral surface of the photosensitive drum 1. It is approximately 1 μm thick, and is composed of resin (Amilan) and methoxyl nylon. Its electrical resistance has been adjusted to approximately $10^6$ ohm.cm. The third layer id is approximately 0.3 μm thick, and is composed of resin in which diazoic pigment has been dispersed. It generates a pair of negative and positive charge as it is exposed to the aforementioned laser beam L. The fourth layer 1*e* is a charge transfer layer composed of polycarbonate resin in which hydrazone has been dispersed. In other words, the fourth layer 1*e* is constituted of P-type semiconductor.

Therefore, the negative charge given to the peripheral surface of the photosensitive drum 1 is not allowed to go through the fourth layer 1*e*, whereas the positive charge generated in the charge generation layer 1*d* is allowed to transfer to the peripheral surface of the photosensitive drum 1. The fifth layer 1*f* is a charge injection layer, which is approximately 3 μm thick. It is composed of photo-curing acrylic resin as binder, and electrically conductive particles 1*g* dispersed in the regain. In this embodiment, the electrically conductive particles 1*g* are ultramicroscopic particles of tin oxide doped with antimony to reduce electrical resistance. They are 0.3 μm in diameter, and are transmissive of light. The ratio of the tin oxide particles relative to the binder is 70 percent in weight. The electrical resistance of this fifth layer 1*f*, or the charge injection layer 1*f*, is desired to be in a range of $1\times10^{10}$–$1\times10^{14}$ ohm.cm so that the photosensitive drum 1 can be sufficiently charged and also the so-called flowing image effect can be prevented. The actual volumetric resistivity of the charge injection layer of the photosensitive drum 1 in this embodiment wax $1\times10^{11}$ ohm.cm, which was obtained by measuring a sample sheet of the charge injection layer with the use of High Resistance Meter 4329A (Yokogawa-Hewlett Packard), and Resistivity Cell 16008A (Yokogawa-Hewlett Packard) which is connected to High Resistance Meter 4329A.

Figure 2:
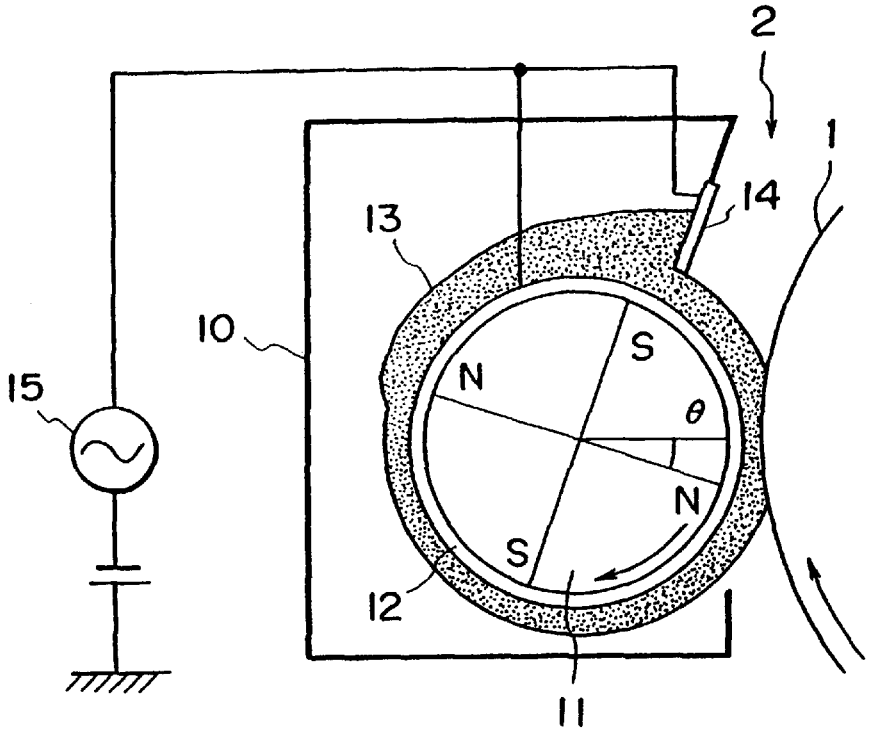
FIG. 2 is a schematic section of the magnetic brush based charging apparatus of the image forming apparatus in the first embodiment of the present invention, and depicts the general structure thereof.

Referring to FIG. 2, the magnetic brush based charging apparatus 2 has a charging apparatus shell 10, a magnetic roller 11, a sleeve 12, electrically conductive magnetic particles 13, and a regulator blade 14. The magnetic roller 11 is fixedly disposed. The sleeve 12 is formed of nonmagnetic material (for example, stainless steel) and is rotatively fitted around the magnetic roller 11. The magnetic particles 13 are borne on the peripheral surface of the sleeve 12, and come in contact with the photosensitive drum 1 to inject electrical charge into the photosensitive drum 1. The regulator blade 14 is formed of nonmagnetic material (for example, stainless steel). It regulates the thickness of the layer of magnetic particles 13 borne on the peripheral surface of the sleeve 12.

The sleeve 12 is rotated in the same direction as the photosensitive drum 1 (clockwise direction) at a peripheral velocity of 225 mm/sec. The regulator blade 14 is positioned so that the gap between the tip of the regulator blade 14 and the peripheral surface of the sleeve 12 becomes 900 μm.

The magnetic roller 11 is disposed so that its N pole (main pole) with a magnetically inductive force of approximately 900 gauss is positioned ten degrees upstream, in terms of the rotational direction of the photosensitive drum 1, from the point at which the distance between the sleeve 12 and the photosensitive drum 1 is shortest. This main pole is desired to be positioned so that its angle θ from the point at which the distance between the sleeve 12 and the photosensitive drum 1 is shortest remains within a range from 20 deg. upstream to 10 deg. downstream, preferably, from 0 deg. to 15 deg. upstream, in terms of the rotational direction of the photosensitive drum 1. If the angle θ is outside the aforementioned range, on the downstream side, the magnetic particles 13 are attracted toward the main pole position, which is likely to cause the magnetic particles 13 to collect on the downstream side of the charging nip, whereas if the angle θ is outside the aforementioned range, on the upstream side, the efficiency with which the magnetic particles 13 are conveyed after being conveyed through the charging nip is poor, which also is likely to cause the magnetic particles 13 to collect.

Further, if no magnetic pole is present within the range correspondent to the charging nip, the force which pulls the magnetic particles 13 toward the sleeve 12 is weak, which obviously is likely to allow the magnetic particles 13 to adhere to the photosensitive drum 1. It should be noted here that the aforementioned charging nip means the region across which the magnetic particles 13 are in contact with the photosensitive drum 1 when the photosensitive drum 1 is being charged.

To the sleeve 12 and the regulator blade 14, charge bias (compound voltage composed of DC voltage and AC voltage) is applied from a charge bias power source 15. The potential level of the DC component of the charge bias is set to be the same as the necessary surface potential level for the photosensitive drum 1 (in this embodiment, −700 V).

The peak-to-peak voltage (Vpp) of the AC component of the charge bias is desired to be in a range of 100–2000 V, preferably, in a range of 300–1200 V. If the peak-to-peak voltage Vpp is no more than 100 V, the effect of the AC component is marginal in terms of improving the uniformity with which the charge is given to the photosensitive drum 1, and also the startup of the electrical charge on the photosensitive drum 1, whereas if it is more than 2000 V, the aforementioned collection of the magnetic particles 13 and/or the adhesion of the magnetic particles 13 to the photosensitive drum 1, worsen. As for the frequency of the AC component, it is desired to be in a range of 100–500 Hz, preferably in a range of 500–2000 Hz. If it is no more than 100 Hz, the adhesion of the magnetic particles 13 to the photosensitive drum 1 worsens, and also, the effect of the AC component is marginal in terms of improving the uniformity with which the photosensitive drum 1 is charged, and also improving the startup of the electrical charge on the photosensitive drum 1. If it is more than 5000 Hz, the effect of the AC component is also marginal in terms of improving the uniformity with which the photosensitive drum 1 is charged, and the startup of the charge on the photosensitive drum 1. The waveform of the AC voltage is desired to be in a rectangular form, a triangular form, a sine curve, and the like. The AC component may be composed by periodically changing the output of a DC power source.

In this embodiment, the peak-to-peak voltage Vpp of the AC component of the charge bias is kept at 700 V during image formation, and at 0 V while the toner particles having mixed into the magnetic particles 13 are expelled. In other words, while the region of the photosensitive drum 1, which is correspondent to the image region, is in the charging station, such a charge bias that is composed of a DC voltage of −700 V and an AC voltage with a peak-to-peak voltage Vpp of 700 V is applied to minimize the potential level difference ΔV between the applied DC voltage (−700 V) and the potential level to which the photosensitive drum 1 is charged. On the other hand, while the region of the photosensitive drum 1, which is correspondent to the imageless region, for example, the region correspondent to a sheet interval, the region correspondent to the background portion of a latent image, or the region correspondent to the post-image formation rotation, is in the charging station, such a charge bias that is composed of the DC voltage (−700 V) alone (without the AC component), is applied to increase the potential level difference ΔV, so that the toner particles having mixed into the charging device are expelled onto the photosensitive drum 1. The toner particles having mixed into the charging device are triboelectrically charged to negative polarity by the magnetic brush, and therefore, are expelled onto the photosensitive drum 1 by the function of the electric field generated by the potential level difference ΔV.

The magnetic particles 13 in this embodiment are formed of a substance obtained by reducing sintered ferromagnetic material (ferrite). However, particles formed of a substance obtained by kneading resin and ferromagnetic material, particles formed of a substance obtained by kneading resin, ferromagnetic material, and electrical resistance adjuster such as electrically conductive carbon or the like, and substantially the same particles as the preceding particles except for the addition of surface treatment, may be similarly used. The magnetic particles 13 must be able to play two roles: they must be able to desirably inject electrical charge into the traps in the surface layer of the photosensitive drum 1, and also must be able to prevent charge current from converging to the defects, such as pin holes, of the photosensitive drum 1 and destroying the magnetic particles 13 and the photosensitive drum 1.

Thus, the electrical resistance value of the magnetic particles 13 is desired to be in a range of $1\times10^4$–$1\times10^9$ ohm, preferably, in a range of $1\times10^4$–$1\times10^7$ ohm, more preferably, in a range of $1\times10^4$–$1\times10^7$ ohm. If the electrical resistance value of the magnetic particles 13 is less than $1\times10^4$ ohm, pin hole leakage is likely to occur, whereas if it exceeds $1\times10^9$ ohm, electrical charge is unlikely to be desirably injected. In order to keep the electrical resistance value of the magnetic particles 13 within the aforementioned range, the volumetric resistance value of the magnetic particles 13 is desired to be in a range of $1\times10^4$–$1\times10^9$ ohm.cm, in particular, in a range of $1\times10^4$–$1\times10^7$ ohm.cm. In this embodiment, the magnetic particles 13 with a volumetric resistance value of $1\times10^6$ ohm.cm are used.

Figure 3:
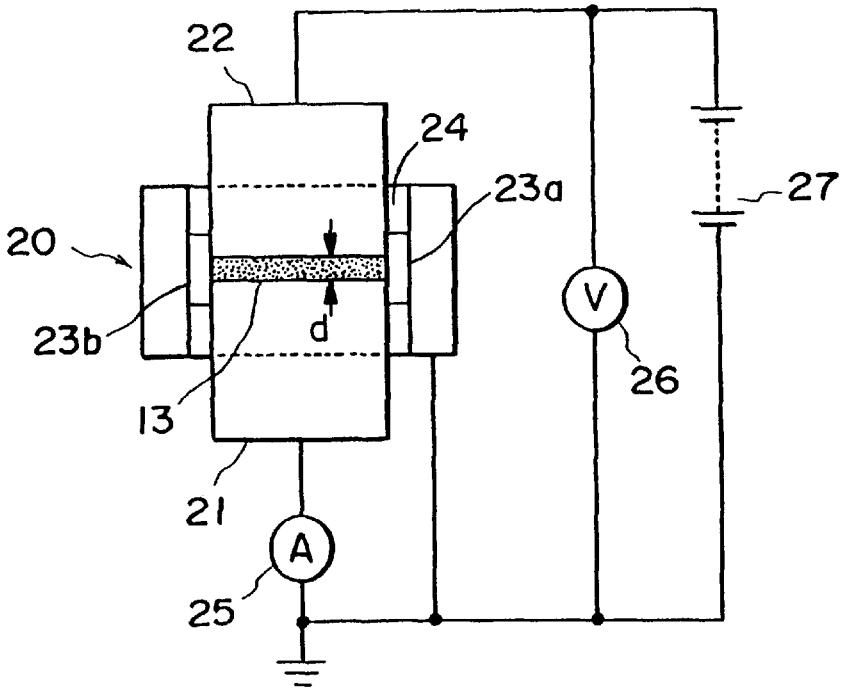
FIG. 3 is a schematic drawing of an apparatus for measuring the electrical resistance of magnetic particles.

The volumetric resistance value of the magnetic particles 13 was measured using the measuring apparatus illustrated in FIG. 3. In measuring the volumetric resistance value of the magnetic particles 13, the magnetic particles 13 are filled into the cell 20, and the main electrode 21 and the top electrode 22 are placed in contact with the magnetic particles 13 filled in the cell 20. Then, voltage is applied between the main and top electrodes 21 and 22, and the current which flows between the two electrodes is measured. Then, the volumetric resistance value of the magnetic particles 13 is calculated from the thus obtained current value.

More specifically, in measuring the electrical resistance value of the magnetic particles 13 in this embodiment, the ambient conditions in which the magnetic particles 13 were filled into the cell 20 were 23° C. in temperature, and 65% in humidity. The size of the contact area between the magnetic particles 13 packed in the cell and the electrode 21 or 22 was 2 $cm^2$. The thickness d of the layer of the magnetic particles 13 in the cell was 1 mm. The load placed upon the top electrode 22 was 10 kg, and the voltage applied between the two electrodes was 100 V. In the same drawing, referential characters 23*a* and 23*b* designate pieces of insulator; 24, a guide ring; 25, a current meter; 26, a voltage meter; and a referential FIG. 27 designates a voltage stabilizer.

From the standpoint of preventing the charging performance from being deteriorated by the surface contamination of the magnetic particles 13, the peak of the particle size distribution curve obtained by measuring the average particle diameter of the magnetic particles 13 is desired to be in a range of 5–100 $\mu$m.

The developing apparatus 3 in this embodiment is a contact type developing apparatus which uses developer T composed of two components. It is equipped with a freely rotatable development sleeve 30, in which a magnetic roller (unillustrated) is fixedly disposed. As the development sleeve 30 is rotated, the developer T contained in the developer container 31 is coated in a thin layer on the peripheral surface of the development sleeve 30, and then is carried to the development station.

The developer T is composed of two components: negatively chargeable nonmagnetic toner particles with an average diameter of 8 $\mu$m, and positively chargeable magnetic carrier particles with an average diameter of 50 $\mu$m. The toner density relative to the magnetic carrier is 5 wt. %. The toner in this embodiment was manufactured by a polymerization method. Its particles are more spherical than those of the ordinary toner used in this type of apparatus, being therefore superior in fluidity.

To the development sleeve 30, development bias is applied from a development bias power source 32. The development bias is a compound voltage composed of DC voltage, for example, a voltage of −400 V, and AC voltage, for example, a voltage with a peak-to-peak voltage of 2000 V and a frequency of 2000 Hz.

The transferring apparatus 4 in this embodiment is a corona based charging device, to which a transfer bias power source 33 is connected. The transfer apparatus 4 may be a contact type charging device, instead of a corona based charging device. For example, it may be a combination of one of a charging brush, an electrically conductive roller, or a transfer belt, and one of an electrically conductive brush, an electrically conductive blade, an electrically conductive roller, or the like, which is positioned to oppose one of the preceding members.

The pre-exposing lamp 6 is disposed along the peripheral surface of the photosensitive drum 1, after the magnetic brush based charging apparatus 2 and before the transferring apparatus 4, in terms of the rotational direction of the photosensitive drum 1. The peripheral surface of photosensitive drum 1 is exposed to the light from the pre-exposing lamp 6. To the pre-exposing lamp 6, an exposure bias power source 34 is connected.

The timings for turning on or off the charge bias power source 15, the development bias 32, the transfer bias power source 33, and the exposure bias power source 34, that is, the timings for turning on or off the pertinent biases, are collected by a controlling apparatus 35 (CPU).

Next, the image forming operation of the above described image forming apparatus will be described.

In forming images, the photosensitive drum 1 is rotatively driven in the direction indicated by an arrow mark a by a driving means (unillustrated), and is charged to a potential level of approximately −700 V by a magnetic brush based charging apparatus 2. Then, a laser exposure beam L modulated with image signals is projected onto the peripheral surface of the photosensitive drum 1. As a result, the potential level of the portions of the peripheral surface of the photosensitive drum 1 exposed to the laser beam L falls, effecting an electrostatic latent image. Then, the electrostatic latent image is developed in reverse by the developing apparatus 3; the negatively charged toner particles are adhered to the peripheral surface of the photosensitive drum 1, on the portions exposed to the laser beam L. The image forming apparatus in this embodiment displayed a characteristic that when the difference in potential level between the potential level to which the peripheral surface of the photosensitive drum was charged, and the DC component of the development bias, was no more than 200 V, fog appeared, and when the difference was no less than 350 V, the carrier of the developer adhered to the photosensitive drum 1. Therefore, in this embodiment, the potential level of the DC component of the development bias was set to −400 V.

The toner image on the photosensitive drum 1 is transferred onto a piece of transfer medium P, for example, a sheet of paper, which is picked out of a sheet feeder cassette 7, and is delivered to the transferring apparatus 4 (corona based charging apparatus) by way of a pair of sheet feeder rollers 8.

The transfer medium P, onto which the toner image has been transferred, is conveyed by a conveyer belt (unillustrated) to the fixing apparatus 5 (thermal roller based fixing apparatus), in which the toner image is thermally fixed to the transfer medium P. Then, the transfer medium P is discharged.

Meanwhile, the residual toner particles, that is, the toner particles which have failed to be transferred and have remained on the peripheral surface of the photosensitive drum 1, are temporarily recovered by the magnetic brush of the magnetic brush based charging apparatus 2; they are temporarily mixed among the magnetic particles 13. Further, before a given point of the peripheral surface of the photosensitive drum 1 enters the charging station, the potential level of this point is reduced to approximately 0 V by the aforementioned pre-exposing lamp 6 located between the transferring apparatus 4 and the magnetic brush based charging apparatus 2. Instead of using the pre-exposing lamp 6, an electrically conductive brush may be used to obtain the same result. In the case of the electrically conductive brush, the brush is placed in contact with the photosensitive drum 1, and AC bias, DC bias with the polarity opposite to that of the surface potential of the photosensitive drum 1, or compound bias composed of AC bias and DC bias with the polarity opposite to that of the surface potential of the photosensitive drum 1, is applied to the brush.

At the same time as the residual toner particles are recovered by the charging apparatus 2, the photosensitive drum 1 is charged by the charging apparatus 2. As the amount of the toner particles recovered by the charging apparatus 2 increases, that is, as the amount of the toner particles which have mixed into the magnetic particles in the charging apparatus 2 increases, the aforementioned potential level difference $\Delta V$ increases even if compound voltage composed of AC voltage and DC voltage is being applied. As a result, the toner particles are gradually expelled from the charging apparatus 2 onto the photosensitive drum 1. However, as described before, the potential level difference $\Delta V$ is smaller while the compound voltage composed of AC voltage and DC voltage is applied than when DC voltage alone is being applied. Thus, the photosensitive drum 1 is exposed, with the small amount of the toner particles having been expelled from the charging apparatus 2 remaining on the photosensitive drum 1, and an electrostatic latent image is formed thereon. In the development station, at the same time as an electric field which causes the toner particles on the development sleeve 30 to adhere to the peripheral surface of the photosensitive drum 1, on the regions correspondent to the light portions of the electrostatic latent image, is formed, another electric field, which causes the toner particles on the regions of the peripheral surface of the photosensitive drum 1, correspondent to the dark portions of the electrostatic latent image, to be recovered by the development sleeve 30, is generated. In other words, the developing apparatus 3 carries out the developing operation and the cleaning operation at the same time.

Figure 4:
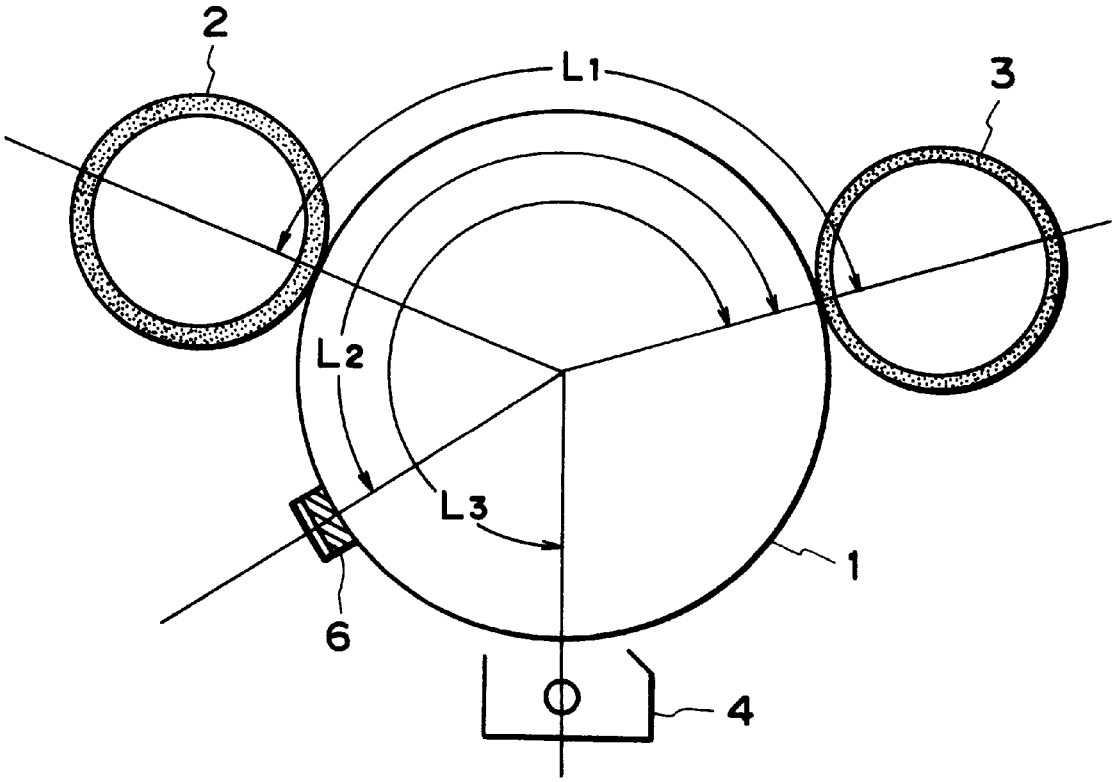
FIG. 4 is a schematic cross-sectional drawing of the photosensitive drum and the components adjacent to the drum, and shows the positional relationship among them.

FIG. 4 is a drawing which shows the positions of the magnetic brush based charging apparatus 2, the developing apparatus 3, the transferring apparatus 4, and the pre-exposing lamp 6, which are disposed adjacent to the photosensitive drum 1 in a manner to surround the photosensitive drum 1, that is, their positions during the aforementioned image forming operation. It also shows the distances among them. In this embodiment, the distance L1 from the magnetic brush based charging apparatus 2 to the developing apparatus 3 in the rotational direction of the photosensitive drum 1 along the peripheral surface of the photosensitive drum 1 is 40 mm, and the distance L2 from the pre-exposing lamp 6 to the developing apparatus 3 in the rotational direction of the photosensitive drum 1 along the peripheral surface of the photosensitive drum 1 is 50 mm. The distance L3 from the transferring apparatus 4 to the developing apparatus 3 in the rotational direction of the photosensitive drum 1 along the peripheral surface of the photosensitive drum 1 is 75 mm. The peripheral velocity of the photosensitive drum 1 is 150 mm/sec. Therefore, the times it takes for a given point of the peripheral surface of the photosensitive drum 1 to move the distances L1, L2 and L3 are 267 milliseconds, 333 milliseconds, and 500 milliseconds, respectively.

Figure 5:
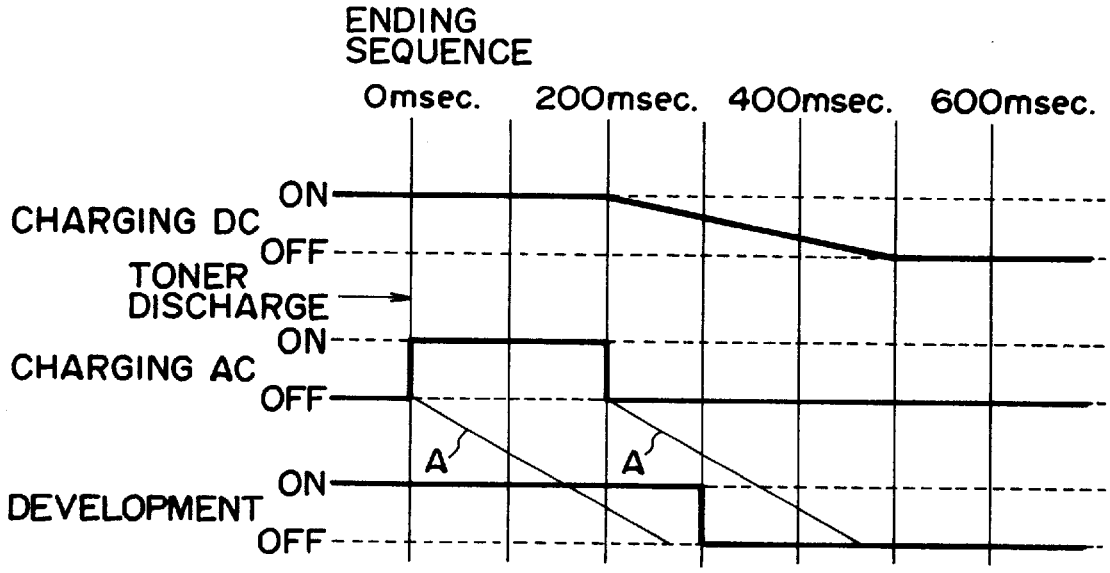
FIG. 5 is a graphical drawing which depicts the post-image formation rotation sequence in the first embodiment.
Figure 6:
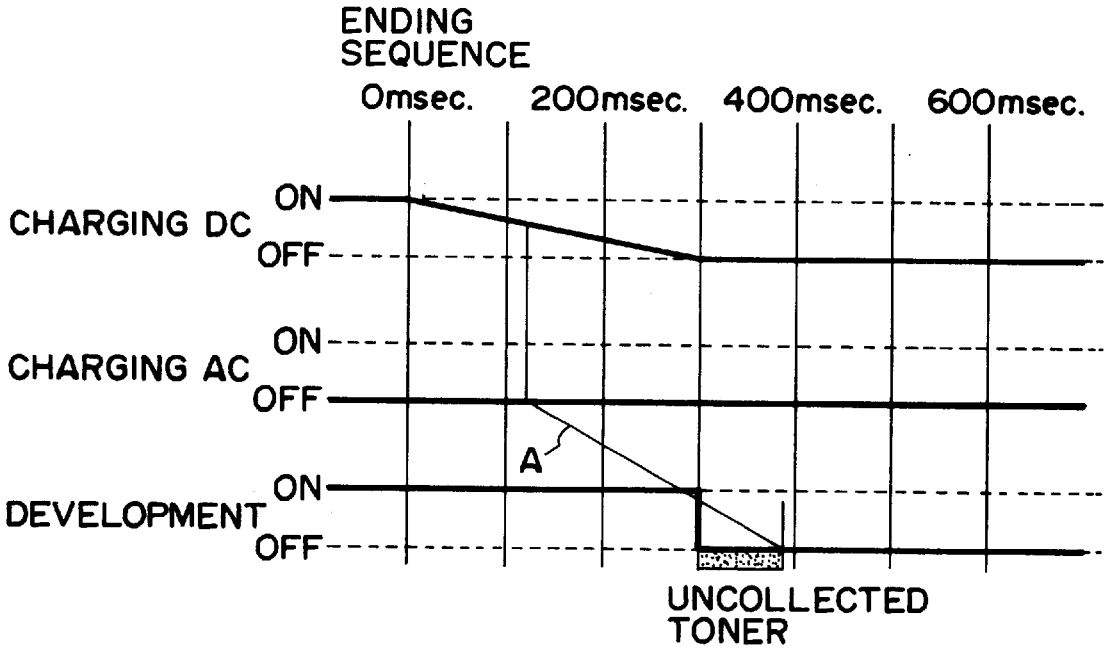
FIG. 6 is a graphical drawing which depicts the comparative post-image formation rotation sequence to the sequence in the first embodiment.

In the image forming apparatus in this embodiment, in which the sleeve 12 of the magnetic brush based charging apparatus 2 bears the magnetic particles 13 among which the residual toner particles have mixed by 1 wt. %, the photosensitive drum 1 is rotated after the completion of each image formation cycle. FIG. 5 is a graphical drawing which shows the sequence of this post-image formation rotation (hereinafter, "post-rotation") in this embodiment, and FIG. 6 is a graphical drawing which shows the sequence of a comparative post-rotation.

Referring to FIG. 5, as soon as the charging of the region of the peripheral surface of the photosensitive drum 1, which will become the image region, is ended, the status of the AC component of the charge bias is changed from ON to OFF, starting thereby to expel the toner particles (residual toner particles), which have mixed among the magnetic particles 13. Then, the status of the AC component is changed from OFF to ON again. This point in time at which the status of the AC component is changed from OFF to ON again is the referential point in time (0 millisecond) in the drawing. As described above, it takes 267 milliseconds for a given point of the peripheral surface of the photosensitive drum 1 to move the distance L1 between the charging station and the developing station, and therefore, the controlling apparatus 35 (CPU) controls the charge bias power source 15 and the development bias power source 32 in such a manner that the potential level of the DC component of the charge bias begins to be reduced 100 milliseconds before the status of the development bias is changed from ON to OFF. Then, the potential level of the DC component of the charge bias is reduced from 700 V to 0 V (gradually reduced and turned off) in 300 milliseconds, to prevent the magnetic particles 13 from adhering to the photosensitive drum 1.

In other words, in the case of the post-rotation sequence illustrated in FIG. 5, the status of the AC component of the charge bias is changed to ON again 300 milliseconds before the status of the development bias is changed from ON to OFF. Then, it is changed to OFF 100 milliseconds before the status of the development bias is changed from ON to OFF. The slanted line A in FIG. 5 is such a line that connects the point in time at which a given point of the peripheral surface of the photosensitive drum 1 is at the charging point, and the point in time at which the same point of the peripheral surface of the photosensitive drum 1 arrives at the developing point.

The toner particles are expelled onto the photosensitive drum 1 while the charge bias, the ΔC component of which has been turned off, is applied, that is, while only the DC component of the charge bias is applied. However, while the region of the photosensitive drum 1, onto which the toner particles have been expelled, is in the development station, the status of the development bias is ON, and therefore, the toner particles on the photosensitive drum 1, on the region in the development station, are recovered into the developing apparatus. On the other hand, while both the AC and DC components of the charge bias are applied to the charging apparatus, the toner particles are scarcely expelled from the charging apparatus. Therefore, there remain scarcely any toner particles on the region of the peripheral surface of photosensitive drum 1, which passes the charging station while the statuses of both the AC and DC component are ON.

Further, by the time the region of the peripheral surface of the photosensitive drum 1, which has passed the charging station while the status of the charge bias has been OFF, that is, the region of peripheral surface of the photosensitive drum 1, which has not been charged, arrives at the development station, the status of the development bias will have been changed from ON to OFF, and therefore, such an electric field that causes the toner particles to adhere from the development sleeve to the photosensitive drum 1 at the development station will not be present at the development station. Thus, the toner particles from the developing apparatus can be prevented from remaining on the region of the photosensitive drum 1, which is adjacent to the developing station when the status of the development bias is changed from ON to OFF.

The controlling apparatus 35 (CPU) executes a control so that the point in time at which the status of the bias applied to the pre-exposing lamp 6 from the pre-exposure bias power source 34 is changed from ON to OFF becomes at least L2/V milliseconds before the point in time at which the status of the development bias is changed from ON to OFF. As described before, the referential character L2 stands for the distance from the pre-exposing lamp 6 to the developing apparatus 3 in the rotational direction of the photosensitive drum 1 along the peripheral surface of the photosensitive drum 1, and the referential character V stands for the peripheral velocity of the photosensitive drum 1 (150 mm/sec).

When the region of the photosensitive drum 1, which has been exposed to the pre-exposing lamp 6, and the region of the photosensitive drum 1, which has not been exposed to the pre-exposing lamp 6, are charged under the same conditions, the pre-exposed region of the photosensitive drum 1 is charged to the lower potential level in comparison to the potential level to which the unexposed region of the photosensitive drum 1 is charged. In other words, the potential level difference ΔV between the pre-exposed region of the photosensitive drum 1 and the potential level of the voltage applied to charge the photosensitive drum 1 becomes greater than the potential level difference ΔV between the unexposed regions of the photosensitive drum and the potential level of the voltage applied to charge the photosensitive drum 1. Therefore, the amount by which the toner particles are expelled from the charging apparatus onto the pre-exposed region of the photosensitive drum 1 is greater than the amount by which the toner particles are expelled from the charging apparatus onto the unexposed region of the photosensitive drum 1. Thus, in order to recover the toner particles expelled from the charging apparatus onto the pre-exposed region of the photosensitive drum by the developing apparatus, it is desirable that the point in time at which the status of the pre-exposing lamp 6 is changed from ON to OFF is set to be at least L2/V milliseconds before the point in time at which the status of the development bias is changed from ON to OFF.

On the other hand, in the case of the comparative post-rotation sequence illustrated in FIG. 6, after the completion of each image formation cycle, the AC component of the charge bias is kept in the OFF status, whereas the DC component of the charge bias is kept in the ON status, being gradually reduced from 700 V to 0 V in 300 milliseconds. Then, the rotation of the photosensitive drum 1 is stopped 300 milliseconds after the application of the DC component of the charge bias is ended.

In tests, in the case of the post-rotation sequence in accordance with the present invention illustrated in FIG. 5, no residual toner particles were seen on the photosensitive drum 1 after the rotation of the photosensitive drum 1 was stopped, whereas in the case of the comparative post-rotation sequence illustrated in FIG. 6, the toner particles, which had been expelled from the charging apparatus, but had not been recovered by the developing apparatus, were found on the photosensitive drum 1, on the region immediately downstream of the developing line by a width of approximately 12 mm in the rotational direction of the photosensitive drum 1.

As described above, in the case of the post-rotation operational sequence in this embodiment, the application of the development bias is stopped while the region of the peripheral surface of the photosensitive drum 1, which has been charged by the application of the compound charge bias composed of DC voltage and AC voltage, is at the developing station. Therefore, after the completion of each image formation cycle, all the toner particles, which have mixed among the magnetic particles 13 borne on the sleeve 12 of the magnetic brush based charging apparatus 2, and have remained among the magnetic particles 13, are expelled from among the magnetic particles 13, and are completely recovered into the developing apparatus 3.

Embodiment 2

Figure 7:
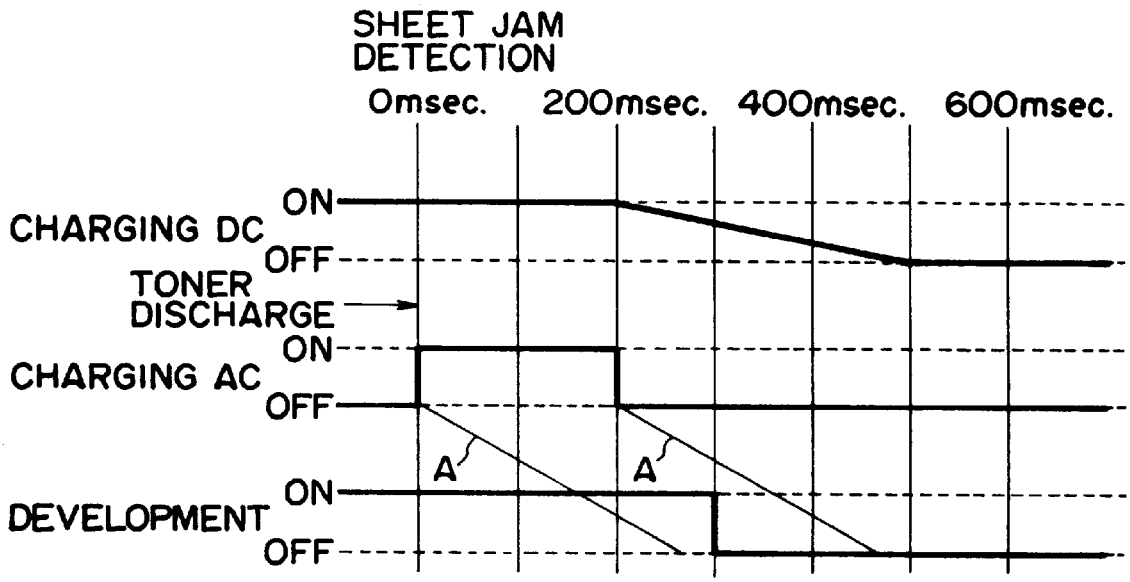
FIG. 7 is a graphical drawing which depicts the post-image formation rotation sequence in the second embodiment.

The image forming apparatus in this embodiment is substantially the same as the one in the first embodiment illustrated in FIG. 1, except for an additional feature that the image forming apparatus is configured so that during a continuous image forming operation, that is, while images are transferred one after another onto a plurality of sheets of transfer medium after a single image formation start signal is inputted, the toner particles are expelled onto the photosensitive drum 1, on the region correspondent to the sheet interval. The structure, and the image forming operation itself, of the image forming apparatus in this embodiment, are essentially the same as those of the image forming apparatus in the first embodiment. Therefore, their descriptions will be omitted here. FIG. 7 is a graphical drawing which shows the operational sequence for ending the post-rotation when a paper jam occurs while toner particles are expelled, and FIG. 8 is a graphical drawing which shows the comparative operational sequence for ending the post-rotation in the same paper jam situation.

Referring to FIG. 7, while toner particles are expelled onto the photosensitive drum 1, on the region correspondent to the sheet interval, the DC component of the charge bias, and the development bias, are kept in the ON status. As soon as a paper jam is detected, the status of the AC component of the charge bias is changed from OFF to ON (this point in time is the referential point in time (0 millisecond) in the drawing. Then, the controlling apparatus 35 (CPU) controls the charge bias power source 15 so that the statuses of both the AC and DC components of the charge bias are changed 200 milliseconds after the referential point in time; the AC component is turned off, and the DC component begins to be gradually reduced in potential level to 0 V in 300 milliseconds. The controlling apparatus 35 also controls the development bias power source 32 so that the application of the development bias is stopped 300 milliseconds after the referential point in time.

Figure 8:
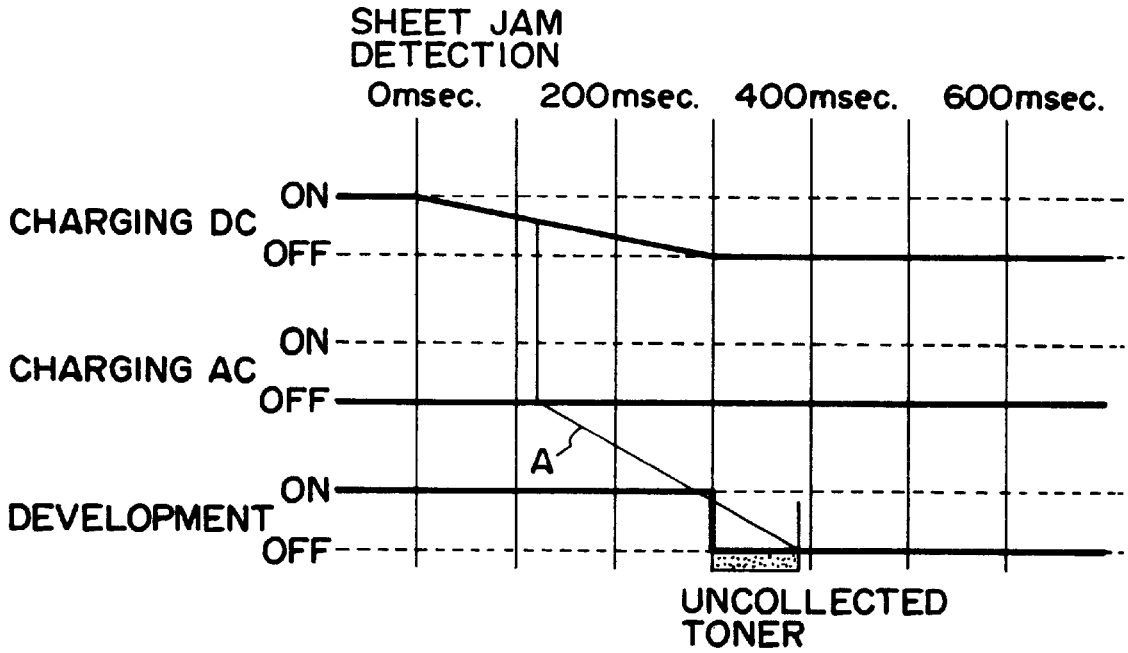
FIG. 8 is a graphical drawing which depicts the comparative post-image formation rotation sequence to the sequence in the second embodiment.

On the other hand, in the case of the comparative sequence illustrated in FIG. 8, the application of the DC component of the charge bias is started at the same time as the detection of a paper jam, and the application of the development bias is stopped at the same time as the ending of the application of the DC component of the charge bias. As for the AC component of the charging bias after the detection of the paper jam, it is left in the OFF status. In both sequences, the rotation of the photosensitive drum 1 is stopped immediately after the application of the DC component of the charge bias is stopped.

In tests, in the case of the sequence illustrated in FIG. 7 for ending the post-rotation operation at the time of a paper jam, no residual toner particles were seen on the photosensitive drum 1 after the stopping of the photosensitive drum 1 rotation, whereas in the case of the comparative sequence illustrated in FIG. 8 for ending the post-rotation operational sequence at the time of a paper jam, the toner particles, which had been expelled from the magnetic brush based charging apparatus 2, and had not been recovered by the developing apparatus 3, remained on the photosensitive drum 1, on the region between the magnetic brush based charging apparatus 2 and the developing apparatus, after stopping the rotation of the photosensitive drum 1.

As described above, according to the present invention, even if a paper (transfer medium) jam occurs while the toner particles are expelled onto the photosensitive drum 1, on the region correspondent to a sheet interval, during an image forming operation in which a plurality of sheets are fed one after another, all the expelled toner particles can be recovered into the developing apparatus 3.

Embodiment 3

Figure 14:
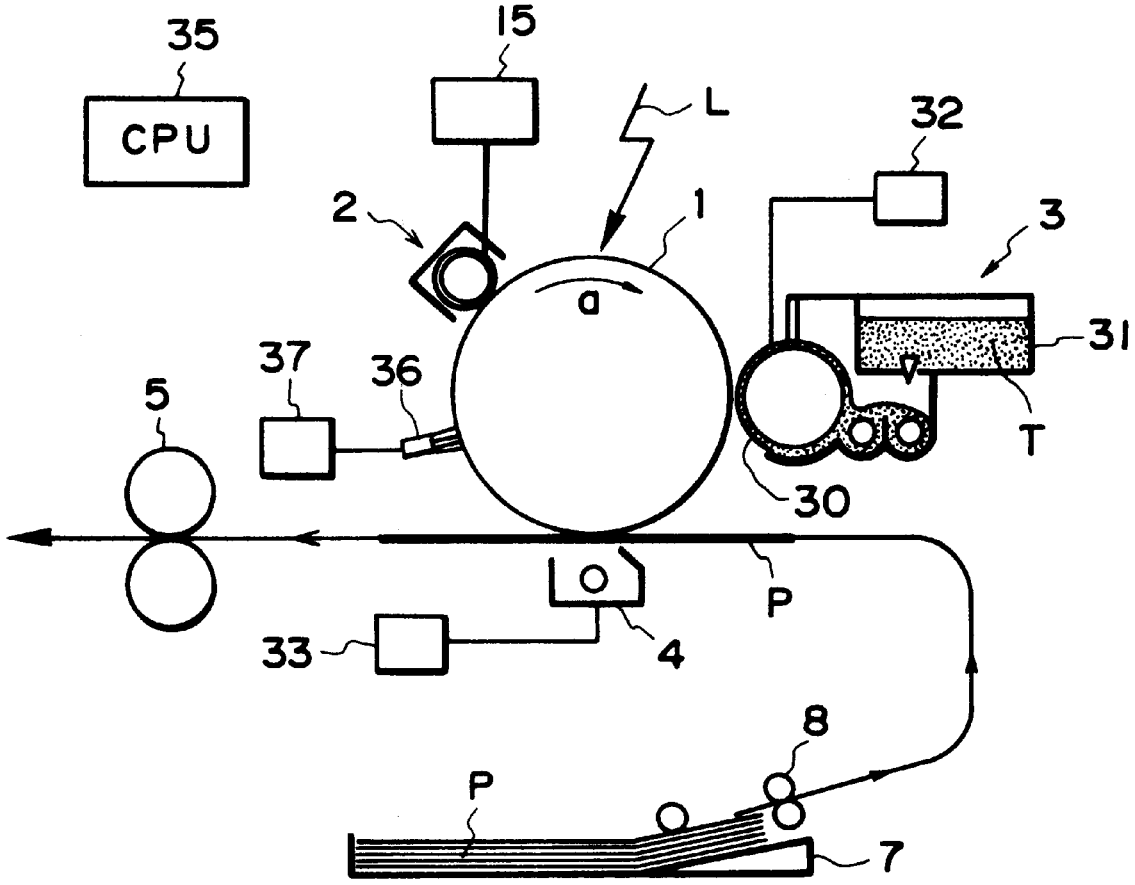
FIG. 14 is a schematic section of the image forming apparatus in the third embodiment of the present invention, and depicts the general structure thereof.

In this embodiment, the post-rotation sequence is carried out with the use of an electrically conductive brush 36 illustrated in FIG. 14, in place of the pre-exposing lamp 6 equipped in the image forming apparatus in the first embodiment illustrated in FIG. 1. The other structure, and the image forming operation itself, of the image forming apparatus in this embodiment, are the same as those of the image forming apparatus in the first embodiment. This electrically conductive brush 36 comprises a bundle of pieces of electrically conductive fiber, which is placed in contact with the peripheral surface of the photosensitive drum 1. To the brush 36, bias is applied from a bias application power source 37 connected to the brush 36.

The image forming apparatus in this embodiment is configured so that, when the residual toner particles pass through the contact region between the electrically conductive brush 36 and the peripheral surface of the photosensitive drum 1, positive voltage, that is, voltage, the polarity of which is opposite to the polarity to which the charging apparatus charges the photosensitive drum 1 (normal polarity to which toner particles are charged), is applied to the electrically conductive brush 36 by the power source 37, uniformly charging the residual toner particles to positive polarity. Having been charged to positive polarity, the residual toner particles are temporarily taken in by the charging apparatus to which negative voltage is being applied. Thus, the toner image pattern, or memory, left on the peripheral surface of the photosensitive drum 1 by the preceding image formation cycle is erased; the toner image pattern from the preceding image formation cycle can be prevented from appearing in the image formed by the following image formation cycle. As for the residual toner particles having mixed among the magnetic particles of the charging apparatus, they are triboelectrically charged to negative polarity by the magnetic particles, and then are expelled onto the photosensitive drum 1.

As described above, in the post-rotation sequence in this embodiment, the photosensitive drum 1 is charged to the polarity opposite to the polarity to which the photosensitive drum 1 is normally charged for image formation by applying bias, the polarity of which is opposite to the normal polarity of the charge bias, to the aforementioned electrically conductive brush 36 from the bias application power source 37. Therefore, if the charging performance of the charging apparatus has deteriorated due to the mixing of the residual toner particles among the magnetic particles 13, a small amount of toner particles is expelled even if compound charge bias composed of DC voltage and AC voltage is applied by the magnetic brush based charging apparatus 2. The same result as the above can be expected even if the bias applied to the electrically conductive brush is compound bias composed of AC voltage in addition to DC voltage, or bias composed of AC voltage alone (photosensitive member is discharged).

Figure 9:
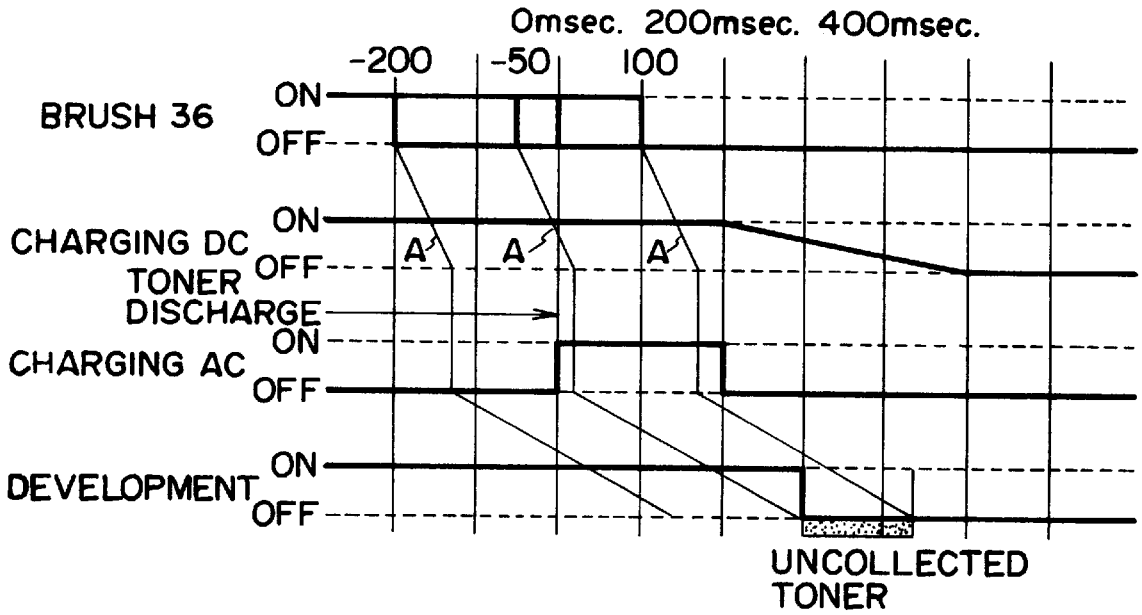
FIG. 9 is a graphical drawing which depicts the post-image formation rotation sequence in the third embodiment.

FIG. 9 is a graphical drawing which depicts the post-rotation sequence in this embodiment, in which the timing with which the charge bias (AC component and DC component), and the development bias, are turned on or off, is the same as that in the first embodiment. Also, the image forming apparatus in this embodiment is the same as the image forming apparatus in the first embodiment, in terms of being equipped with a magnetic brush based charging apparatus 2 which comprises a sleeve 12 on which magnetic particles 13, among which residual toner particles have mixed by 1 wt. % as they had in the first embodiment, are borne.

Referring to FIG. 9, as soon as the charging of the region of the peripheral surface of the photosensitive drum 1, which is to become the image formation region, ended, the application of the AC component of the charging bias is stopped to begin expelling the toner particles 31 having mixed among the magnetic particles 13. Then, the application of the AC component of the charging bias is started again at a predetermined point in time. This point in time is defined as the referential point (0 millisecond) in FIG. 9. As for the timing with which the application of bias to the electrically conductive brush 36 is stopped, three different points in time were tested: −200 milliseconds, −50 milliseconds, and 100 milliseconds after the referential point in time. The distance from the electrically conductive brush 36 to the charging station is 10 mm.

Further, it is desirable that the controlling apparatus 35 (CPU) executes a control so that the application of bias to the electrically conductive brush 36 is started at least L2/V before the development bias is turned off. In this case, a referential character L2 stands for the distance from the electrically conductive brush 36 to the developing apparatus along the peripheral surface of the photosensitive drum 1 in the rotational direction of the photosensitive drum 1 (50 mm), and the referential character V stands for the peripheral velocity of the photosensitive drum 1 (150 mm/sec). Therefore, the value of L2/V is 333 milliseconds.

In the test in which the image forming apparatus was operated following the sequence depicted in FIG. 9 after each image formation cycle, when the application of bias to the electrically conductive brush 36 was stopped at −200 milliseconds, or −50 milliseconds, from the referential point in time, in other words, when the image forming apparatus was configured so that the point in time at which the status of the bias applied to the electrically conductive brush 36 was switched from ON to OFF became no less than L2/V earlier than the point in time at which the status of the development bias was switched from ON to OFF, the toner particles expelled from among the magnetic particles 13 borne on the sleeve 12 of the magnetic brush based charging apparatus 2 were entirely recovered into the developing apparatus 3. However, when the point in time at which the status of the bias applied to the electrically conductive brush 36 was switched from ON to OFF was set up to be 100 milliseconds after the referential point in time, in other words, when the point in time at which the status of the bias applied to the electrically conductive brush 36 was switched from ON to OFF was set up to be no more than L2/V earlier than the point in time at which the status of the development bias was switched from ON to OFF, a small amount of toner particles remained on the photosensitive drum 1.

In comparison to the case in which the bias to the electrically conductive brush 36 is kept in the OFF state, in the case in which the bias is applied to the electrically conductive brush 36, the photosensitive drum 1 is discharged, or positively charged. Therefore, the potential level to which the photosensitive drum 1 is charged by the charging apparatus becomes lower. Thus, in the case in which bias is applied to the electrically conductive brush 36, the potential level difference $\Delta V$ becomes larger, which tends to increase the amount by which the toner particles are expelled from the charging apparatus 2 onto the photosensitive drum 1. Therefore, configuring the image forming apparatus so that the bias applied to the electrically conductive brush 36 is turned off at least L2/V before the development bias is turned off is desirable for reducing the amount by which the toner particles remain on the photosensitive drum 1, because this configuration causes the region of the photosensitive drum 1 correspondent to the period in which the status of the bias applied to the electrically conductive brush 36 is OFF, to be at the development station when the application of the development bias is stopped.

As described above, also in this embodiment, the amount by which the toner particles expelled from among the magnetic particles 13 borne on the sleeve 12 of the magnetic brush based charging apparatus 2, remain on the photosensitive drum 1 without being recovered by the developing apparatus 3, after each image formation cycle, can be reduced.

Embodiment 4

In the post-rotation sequence in this embodiment, instead of using the pre-exposing lamp 6 of the image forming apparatus in the first embodiment illustrated in FIG. 1, or the electrically conductive brush 36 of the image forming apparatus in the third embodiment illustrated in FIG. 14, the surface potential level of the photosensitive drum 1 is reset with the use of the transferring apparatus 4 (transfer charging device) of the image forming apparatus in the first embodiment illustrated in FIG. 1, to which positive voltage is being applied. The structures of the other portions, and the image forming operation itself, of the image forming apparatus in this embodiment are the same as those of the image forming apparatus in the first embodiment.

Figure 10:
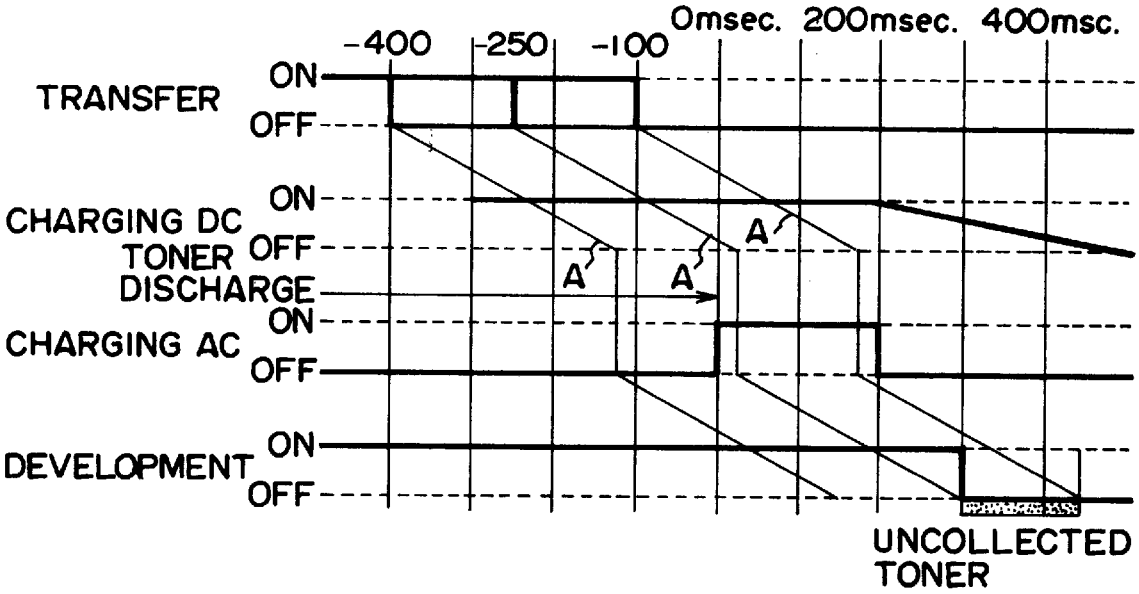
FIG. 10 is a graphical drawing which depicts the comparative post-image formation rotation sequence to the sequence in the third embodiment.
Figure 11:
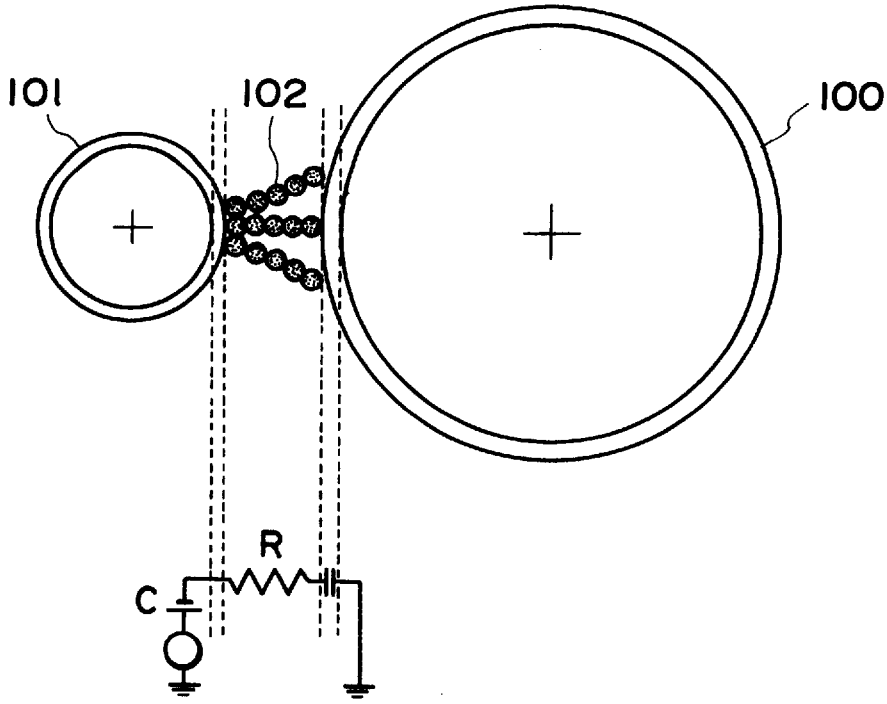
FIG. 11 is a schematic drawing which depicts an electrical circuit constituted of the magnetic brush based charging apparatus and the photosensitive drum, and also presents an electrical circuit equivalent to the preceding circuit.
Figure 12:
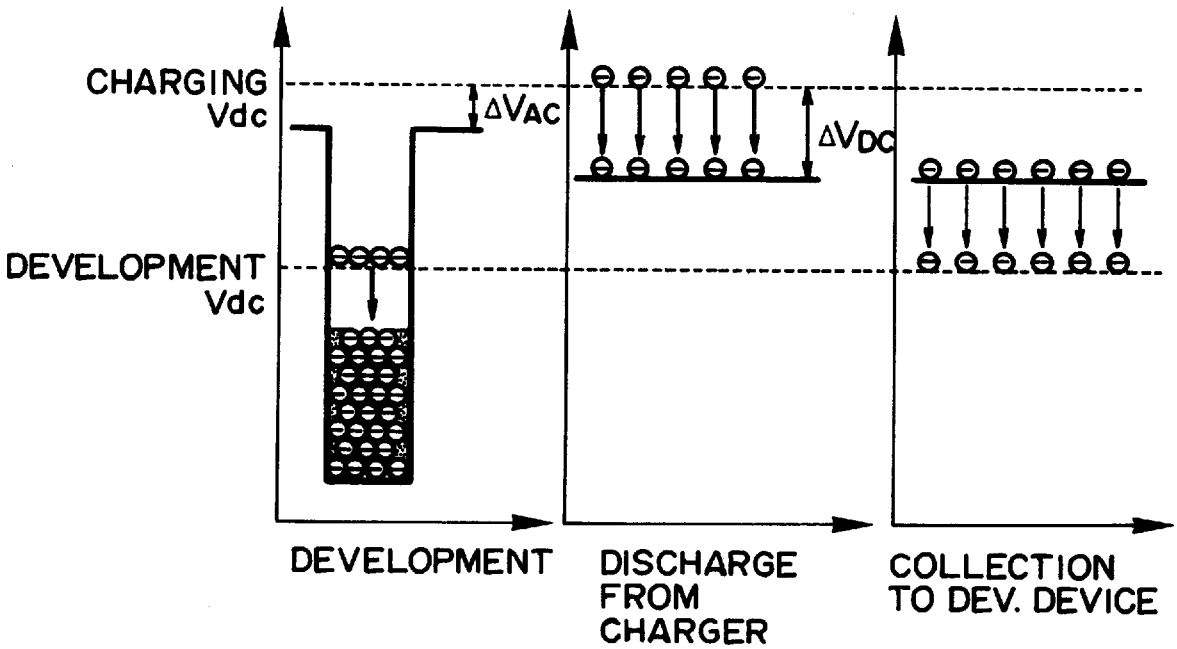
FIG. 12 is a drawing which depicts the principle based on which the toner particles are expelled from the magnetic brush based charging apparatus, and are recovered by the developing apparatus.

FIG. 10 is a graphic drawing which depicts the post-rotation sequence in this embodiment, in which the timing with which the statuses of the charge bias (AC component and DC component) and the development bias are switched between ON and OFF is the same as that in the first embodiment. Also in this embodiment, the image forming apparatus is equipped with a magnetic brush based charging apparatus 2 which comprises a sleeve 12 on which magnetic particles 13, among which residual toner particles have mixed by 1 wt. %, are borne, as was the image forming apparatus in the first embodiment.

Referring to FIG. 10, as soon as the charging of the region of the peripheral surface of the photosensitive drum 1, which is to become the image formation region, ends, the application of the AC component of the charging bias is stopped, to begin expelling the toner particles 31 having been mixed among the magnetic particles 13. Then, the application of the AC component of the charging bias is started again at a predetermined point in time. This point in time is defined as the referential point (0 millisecond) in FIG. 10. As for the timing which the application of bias to the transfer apparatus 4 (transfer charging apparatus) is stopped, three different points in time were tested: −400 milliseconds, −250 milliseconds, and 100 milliseconds after the referential point in time. The distance from the transferring apparatus to the charging station is 25 mm. The image forming apparatus in this embodiment is configured so that the transfer current during image formation becomes 8–15 $\mu$A. However, during the expelling of the toner particles, control must be executed to reduce the transfer current below the normal level in order to prevent memory from being effected on the peripheral surface of the photosensitive drum 1. Thus, during the post-rotation sequence in this embodiment, control is executed so that the transfer current becomes 5 $\mu$A.

Further, the controlling apparatus 35 (CPU) is set up to execute a control so that the application of bias to the transferring apparatus 4 by the transfer bias power source 33 is turned off at least L3/V before the point in time at which the development bias is turned off. In this case, a referential character L3 stands for the distance from transferring apparatus 4 to the developing apparatus 3 in the rotational direction of the photosensitive drum 1 along the peripheral surface of the photosensitive drum 1 (115 mm), and the referential character V stands for the peripheral velocity of the photosensitive drum 1 (50 mm/sec). Therefore, the value of L3/V was 500 milliseconds.

In the test carried out under the above-described conditions, when the application of bias to the transferring apparatus (transfer charging device) was stopped at −400 milliseconds, or −250 milliseconds, before the referential point in time, the toner particles having been mixed among the magnetic particles 13 borne on the sleeve 12 of the magnetic brush based charging apparatus 2 were entirely recovered into the developing apparatus 3 after each image formation cycle. However, when the application of bias to the transferring apparatus 4 was stopped at 100 milliseconds after the referential point in time, a small amount of toner particles remained on the photosensitive drum 1.

As is evident from the above description, also in the case of this embodiment, it was possible to reduce the amount by which the toner particles expelled from among the magnetic particles 13 borne on the sleeve 12 of the magnetic brush based charging apparatus 2 failed to be recovered by the developing apparatus 3 and remained on the photosensitive drum 1 after each image formation cycle.

The preceding embodiments of the present invention were described with reference to black-and-white image forming apparatuses. However, the present invention is also applicable to full-color image forming apparatuses. Further, according to the preceding embodiments, the AC component of the charge bias applied to the charging apparatus 2 is turned off to expel the toner particles out of the charging apparatus 2 onto the photosensitive drum 1. However, the same effect can be accomplished by reducing the peak-to-peak voltage of the AC component of the charge bias, in comparison to the peak-to-peak voltage during image formation, instead of turning off the AC component.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

an image bearing member for bearing an electrostatic image;

charging means for electrically charging said image bearing member, said charging means including electroconductive particles contacted to said image bearing member and a carrying member for carrying the electroconductive particles;

a voltage applying means for applying a DC voltage or a DC-biased, AC oscillating voltage, wherein said charging means charges an image area of said image bearing member in which the electrostatic image is to be formed, by the oscillating voltage;

developing means for developing, at a developing position, the electrostatic image, using a toner having the same polarity as a charging polarity of said charging means, and removing residual toner from said image bearing member;

wherein said charging means charges a nonimage area with the oscillating voltage, after charging with the DC voltage is effected in the nonimage area, and when the charged area provided by the oscillating voltage is in the developing position, the operations of said developing means terminates.

2. An apparatus according to claim 1, wherein the electroconductive particles are magnetic, and said electroconductive particle carrying member carries the electroconductive particles by a magnetic confining force.

3. An apparatus according to claim 1, wherein a peak-to-peak voltage of an alternating voltage applied to said charging means when said charging means charges such an area of said image bearing member as has been at the developing position when the developing operation of said developing means is completed, is substantially the same as that when said charging means charges such an area of said image bearing member as is going to be an image area.

4. An apparatus according to claim 1, further comprising transfer means for transferring the toner image from said image bearing member onto a transfer material, and discharging means, disposed downstream of said transfer means and upstream of said charging means with respect to a movement direction of said image bearing member, for electrically discharging said image bearing member, wherein said discharging means stops its discharging operation at least L2/V (sec) before completion of the developing operation of said developing means, where L2 (mm) is a distance between the discharging means and said developing means measured along a movement direction of said image bearing member, and V (mm/sec) is a peripheral speed of said image bearing member.

5. An apparatus according to claim 1, further comprising transfer means for transferring the toner image from said image bearing member onto a transfer material, and charge application means, disposed downstream of said transfer means and upstream of said charging means with respect to a movement direction of said image bearing member, for applying electric charge of a polarity opposite from the charging polarity of said charging means to residual toner remaining on said image bearing member, wherein voltage application to said charge application means is stopped at least L2/V (sec) before completion of the developing operation of said developing means, where L2 (mm) is a distance between the charge application means and said developing means measured along a movement direction of said image bearing member, and V (mm/sec) is a peripheral speed of said image bearing member.

6. An apparatus according to claim 5, wherein said charge application means includes an electroconductive brush contactable to said image bearing member, and is supplied with a DC voltage of a polarity opposite from the charging polarity of said charging means, an alternating voltage without DC component or an oscillating voltage in the form of a superimposed alternating and DC voltages.

7. An apparatus according to claim 1, wherein further comprising transfer means for transferring the toner image from said image bearing member onto a transfer material, wherein voltage application to said transfer means is stopped operation at least L3/V (sec) before completion of the developing operation of said developing means, where L3 (mm) is a distance between the transfer means and said developing means measured along a movement direction of said image bearing member, and V (mm/sec) is a peripheral speed of said image bearing member.

8. An apparatus according to claim 1, wherein said image bearing member includes a surface layer having a volume resistivity of $1\times10^{10}$ to $1\times10^{14}$ Ohm.cm.

* * * * *

UNITED STATES PATENT AND TRADEMARK OFFICE

CERTIFICATE OF CORRECTION

PATENT NO. : 6,064,837

DATED : May 16, 2000

INVENTOR(S) : KOUICHI HASHIMOTO, ET AL.

It is certified that error appears in the above-identified patent and that said Letters Patent is hereby corrected as shown below:

COLUMN 1:
Line 8, "ar" should read --an--.

COLUMN 2:
Line 2, "among" should read --along--.
Line 39, "ad" should read --and--.

COLUMN 6:
Line 16, "id" should read --1d--.
Line 18, "charge" should read --charges--.
Line 42, "wax" should read --was--.

COLUMN 12:
Line 17, "ΔC" should read --AC--.

COLUMN 14:
Line 15, "drawing." should read --drawing).--

UNITED STATES PATENT AND TRADEMARK OFFICE

CERTIFICATE OF CORRECTION

PATENT NO. : 6,064,837

DATED : May 16, 2000

INVENTOR(S) : KOUICHI HASHIMOTO, ET AL.

It is certified that error appears in the above-identified patent and that said Letters Patent is hereby corrected as shown below:

COLUMN 18:

Line 1, "into" should read --in--.

Line 43, "formed," should read --formed--; and "voltage;" should read --voltage,--.

Line 49, "member;" should read --member,--.

COLUMN 20:

Line 11, "alternating and DC voltages" should read --alternating AC and DC voltages--.

Line 12, "wherein" should be deleted.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*